United States Patent [19]

Sapp

[11] Patent Number: 4,805,900

[45] Date of Patent: Feb. 21, 1989

[54] STRENGTH TRAINING AMUSEMENT DEVICE FOR SIMULATING ARM-WRESTLING

[76] Inventor: William E. Sapp, Rte. 5, Box 39-B, Riverside, Wash. 98849

[21] Appl. No.: 3,669

[22] Filed: Jan. 15, 1987

[51] Int. Cl.[4] ..... A63B 5/00; A63B 21/00; A63B 67/00

[52] U.S. Cl. ..... 272/67; 272/130; 272/901; 273/1 G; 273/85 R

[58] Field of Search ..... 272/67, DIG. 4, DIG. 6, 272/901, 130, 134; 273/1 G, 1 GC, 1 GH, 1 GI, 85 R, 85 H, 85 D; D 10/83; 73/380, 381; 123/198 B; 116/33; 56/10.5

[56] References Cited

U.S. PATENT DOCUMENTS

| | | | |
|---|---|---|---|
| 929,281 | 7/1909 | Brodeur . | |
| 3,228,177 | 1/1966 | Coates | 56/10.5 |
| 3,369,403 | 10/1965 | Carlin et al. | 272/130 |
| 3,400,793 | 9/1968 | Norris et al. . | |
| 3,982,757 | 9/1976 | McDonnell | 272/134 |
| 3,998,100 | 12/1976 | Pizatella et al. | 272/130 |
| 4,176,837 | 12/1979 | Jeffrey et al. | 273/1 R |
| 4,184,675 | 1/1980 | Rogerson | 272/901 |
| 4,220,330 | 9/1980 | Montgomery | 273/1 E |
| 4,406,454 | 9/1983 | Dean | 273/1 GC |
| 4,452,197 | 6/1984 | Weber | 123/198 B |
| 4,482,149 | 11/1984 | Weldon | 272/67 |
| 4,557,481 | 12/1985 | McClure | 273/1 GC |
| 4,575,076 | 3/1986 | Reichert et al. | 272/130 |

*Primary Examiner*—Richard C. Pinkham
*Assistant Examiner*—Mark S. Graham
*Attorney, Agent, or Firm*—Ward Brown; Robert W. Beach

[57] ABSTRACT

An upright mechanical arm is pivoted to a freestanding base for grasping by a player to simulate an arm-wrestling contest. The arm is power-driven in a given direction by a hydraulic jack. The force applied by the jack is adjustable. Switches detect grasping of the mechanical arm by the player and positioning of the player's elbow on an elbow pad. Such switches are interconnected with control of the hydraulic jack to cut off the supply of hydraulic liquid automatically. Bells and buzzers can be provided to indicate when the game has been "won" or "lost" by the player.

4 Claims, 11 Drawing Sheets

STRENGTH TRAINING AMUSEMENT DEVICE FOR SIMULATING ARM-WRESTLING

BACKGROUND OF THE INVENTION

1. Field of the Invention

The present invention relates to amusement devices and, more specifically, to amusement devices usable by a single individual to simulate an arm-wrestling contest.

2. Prior Art

Brodeur U.S. Pat. No. 929,281, issued on July 27, 1909, for a "Muscle Testing Machine". Such machine includes a mechanical arm moved by the user against the force of springs. The mechanical arm is coupled to the pointer of a dial to give an approximate indication of the force applied by the user. The same general concepts were applied by McDonnell in his "Torsion Type Arm Exercising Apparatus" which is the subject of U.S. Pat. No. 3,982,757, issued Sept. 28, 1976. In the McDonnell device there is a mechanical arm moved by the user against the force of springs and coupled to the pointer of a dial to indicate the force applied. The similarity in the two devices patented 67 years apart is some indication of the ongoing interest in arm-exercising machines which measure the strength of the user and, to some degree, simulate an arm-wrestling contest, and also is some indication of the slow progress made in this field over the same period.

Another type of "Mechanical Arm Wrestler" is disclosed in Rogerson U.S. Pat. No. 4,184,675, issued Jan. 22, 1980. In that patent a mechanical arm is moved against the preset pressure of air in a pneumatic cylinder. The preset pressure is achieved by use of a foot pump. Similarly, in the first described embodiment of the "Amusement Device" which is the subject of Norris et al. U.S. Pat. No. 3,400,793, issued Sept. 10, 1968, a mechanical arm is moved against force applied by a pneumatic cylinder and the resistive force applied by the user is indicated on a display.

A second described embodiment in the Norris et al. patent comes closer to the present invention because in that embodiment a mechanical arm is intended to "fight back", as is the mechanical arm of the "Arm Wrestling Apparatus" of Dean U.S. Pat. No. 4,406,454, issued Sept. 27, 1983. In other respects, however, the devices of these patents are dissimilar to the present invention. The second described embodiment of the Norris et al. patent uses an electric clutch assembly, and the Dean device uses a mechanical arm connected by way of a gear assembly to a pair of opposing pneumatic cylinders.

As popularity of arm wrestling as a sport has increased, more recent patents have issued for devices intended to prevent one or the other opponent from gaining an unfair advantage. Such devices are disclosed in Jeffrey et al. U.S. Pat. No. 4,176,837, issued Dec. 4, 1979, and Montgomery U.S. Pat. No. 4,220,330, issued Sept. 2, 1980. Still, arm wrestling as a sport may not be a very reliable indication of a contestant's strength or, in some cases, even of technique, quickness, agility or endurance despite the use of human referees and electronic devices for regulating and judging the grip, starting time and other aspects of the contest.

Up to now the need for a mechanical device for simulating an arm-wrestling contest and having the feel of a human opponent has been unfulfilled Such a device could be used for amusement, practice and strength training, and also could be used as a more objective measure of arm-wrestling strength

SUMMARY OF THE INVENTION

The principal object of the present invention is to provide a mechanical device of simple and inexpensive yet sturdy and reliable construction for simulating an arm-wrestling contest, having the feel of a human opponent and safely usable by contestants of varying strengths and skill whether right-handed or left-handed.

These and other objects are accomplished by the strength training amusement device for simulating arm-wrestling described in detail below.

DETAILED DESCRIPTION

General Construction and Operation

Figure 1:
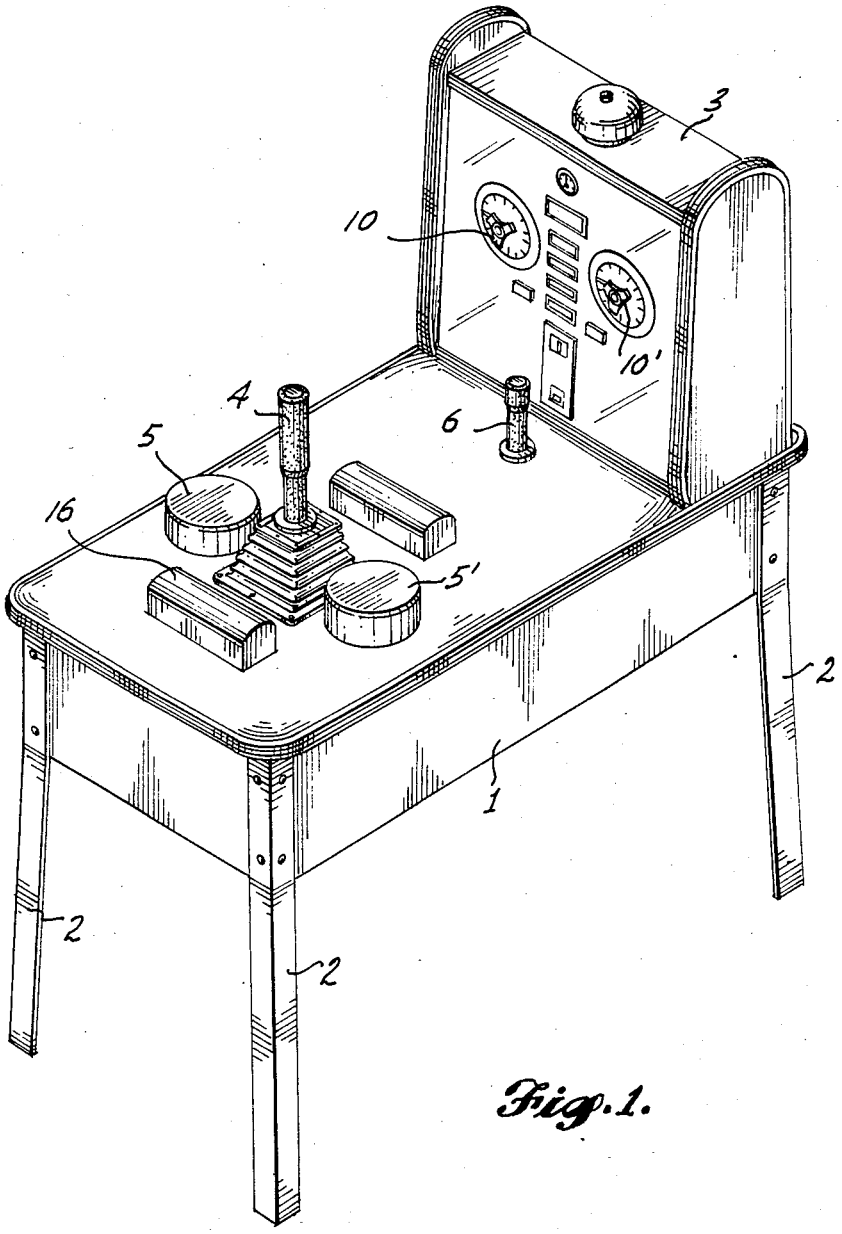
FIG. 1 is a somewhat diagrammatic top perspective of a strength training amusement device for simulating arm-wrestling in accordance with the present invention.

The strength training amusement device for simulating arm-wrestling in accordance with the present invention shown in FIG. 1 has a box-like base 1 supported on legs 2. A display and control box 3 extends upward from one end portion of the base. A movable, upright, mechanical arm 4 projects from the box base toward its end remote from the control box 3 and is flanked by elbow pads 5 and 5' for right-handed and left-handed users, respectively. A stationary upright handgrip 6 is provided adjacent to the control box 3.

Figure 2:
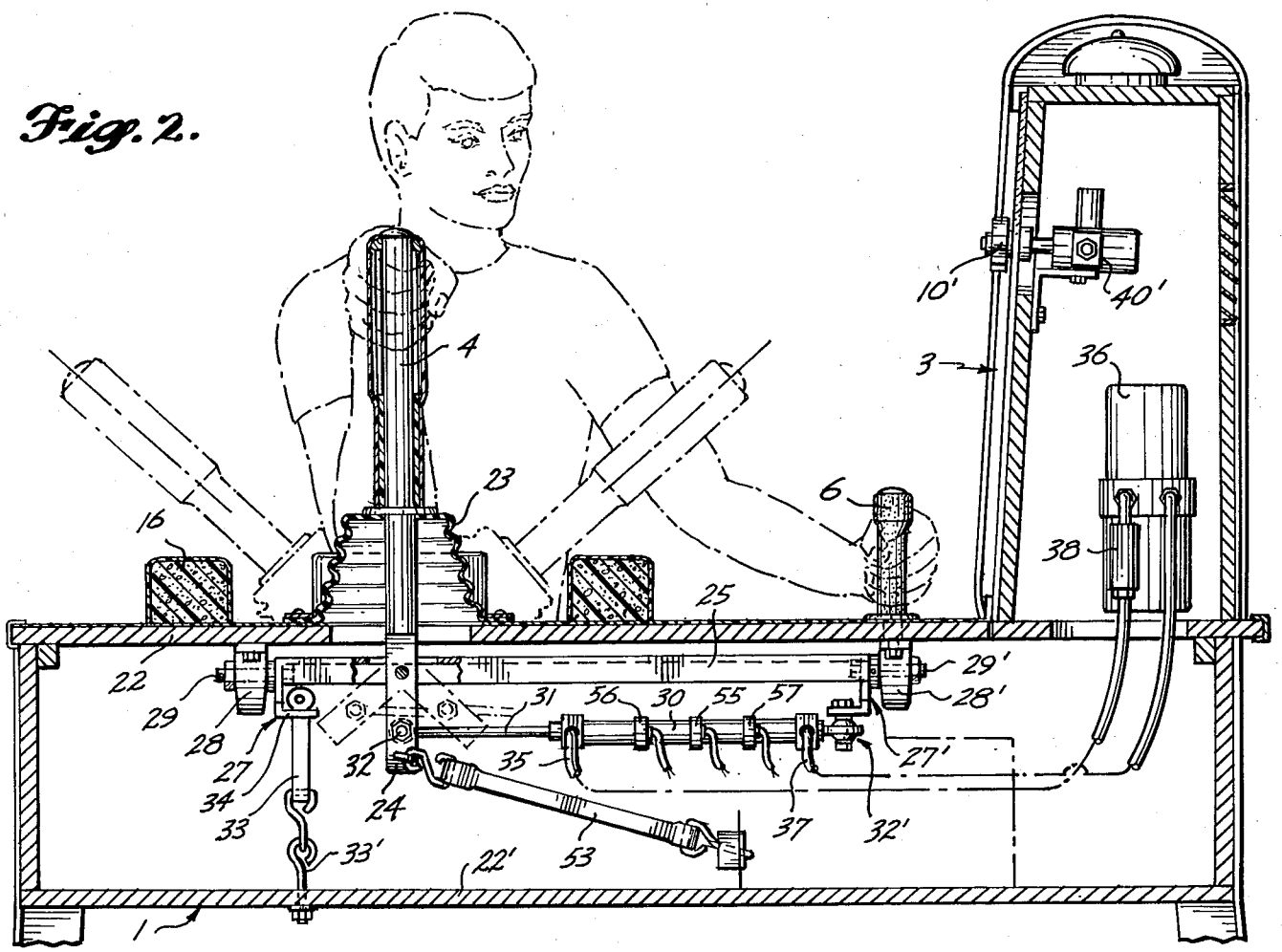
FIG. 2 is a somewhat diagrammatic side elevation of such device with parts broken away.

The position of a right-handed player using the device is shown in FIG. 2. The right hand grips the upper portion of the mechanical arm 4, the right elbow rests on the appropriate elbow pad and the left hand grasps the handgrip 6. A left-handed player would be positioned at the opposite side of the device with his or her back to the viewer.

Figure 3:
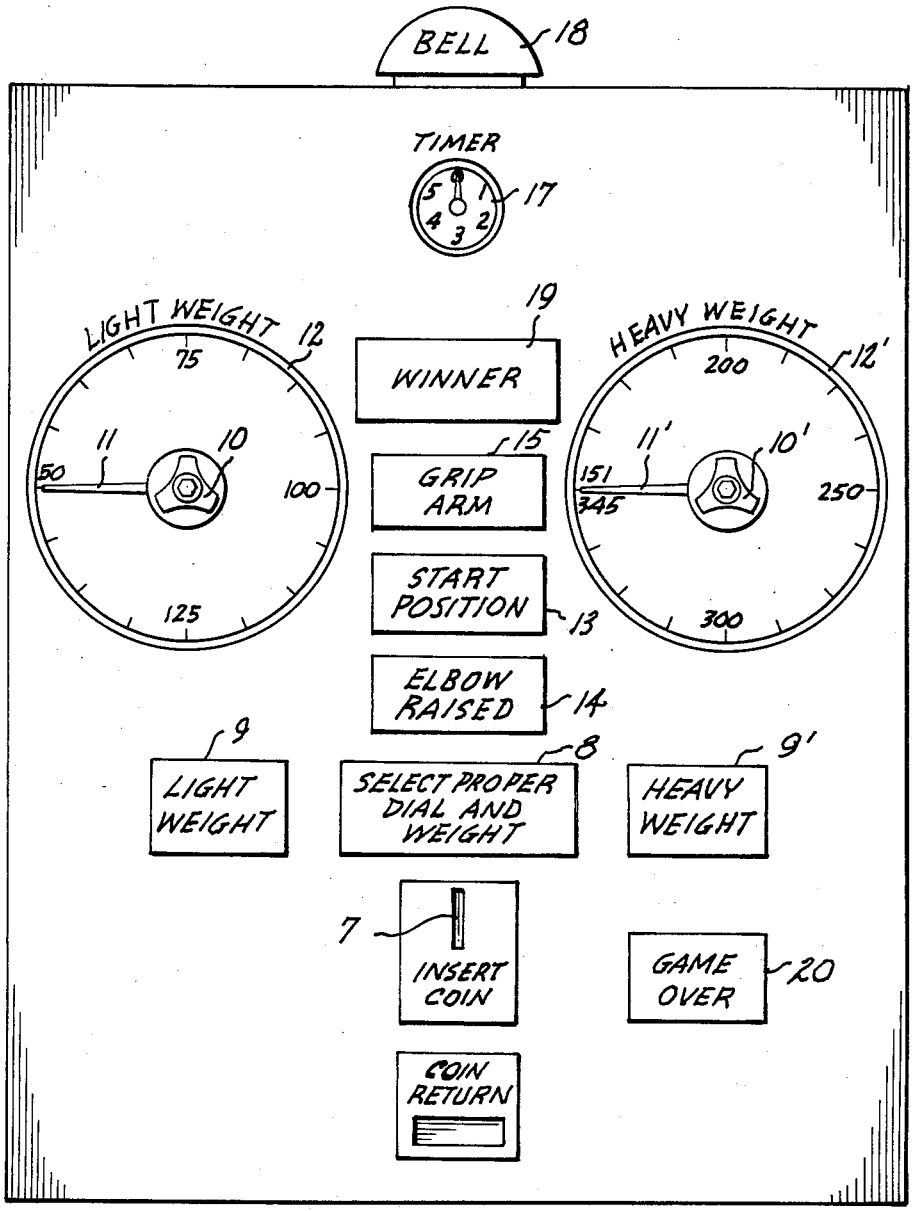
FIG. 3 is a diagrammatic illustration of representative displays, dials and lights that can be used with the present invention.

A representative face panel for the control box 3 is shown in FIG. 3. Insertion of a coin into the machine into the coin slot 7 actuates a light 8 prompting the player to set the maximum force to be applied by the machine. The player can select a force within a weaker "lightweight" range by pushing a button 9 and turning knob 10 which moves a pointer 11 of a dial 12 for an indication of the relative strength of the force selected; or the player can select a force from a stronger "heavyweight" range by pushing button 9' and turning knob 10' which moves pointer 11' relative to the dial 12'. For an initial reference, the dials indicate the recommended starting positions based on the players weight. For example, a player weighing 100 pounds would select the lightweight range and turn knob 10 to move pointer 11 to register with "100".

The player then moves the mechanical arm to its vertical central "start" position, which actuates a light 13, places his or her elbow on the appropriate elbow pad, which extinguishes a light 14, and grasps the mechanical arm, which extinguishes a light 15. The machine immediately applies a force tending to swing the mechanical arm away from the control box which is resisted by the player. If at any time the player lifts his or her elbow or releases the grip on the mechanical arm, the appropriate light is lit and the force applied by the machine automatically ceases. Similarly, if the player is not successful in resisting movement of the mechanical arm, the arm swings down into contact with a back pad 16 seen in FIGS. 1 and 2, light 8 shown in FIG. 3 is lit and the force applied to the mechanical arm by the machine automatically ceases. The player can reset the force to be applied by the machine and resume play until a predetermined time limit is exceeded. The time remaining is indicated on a dial 17 seen in FIG. 3.

If the player is successful in not only resisting the force applied by the machine, but overcoming it so as to move the mechanical arm through a predetermined angle toward the control box, while maintaining contact with the appropriate elbow pad and maintaining the grip on the mechanical arm, a bell 18 and a flashing light 19 are actuated indicating that the player has won and play ceases. A "game over" light 20 is lit when the player wins or when the time limit is exceeded.

Mechanical Structure

As seen in FIG. 2, the mechanical arm 4 extends downward through a hole 21 in the top 22 of the base 1. Such hole 21 is covered by a conventional rubber boot 23. The bottom end portion of the mechanical arm 4 is joined to laterally spaced plates 24, best seen in FIG. 4, extending below the top 22 through an elongated slot in the top web of a long channel member 25. The mechanical arm is pivoted to such channel member for swinging about a horizontal transverse axis by a pin 26.

The opposite ends of the channel member 25 are welded to angle brackets 27 and 27', Such brackets have upright legs connected to stationary bearing blocks 28 and 28' by horizontal bolts 29 and 29' which are rotatable in such blocks. The stationary bearing blocks are, in turn, bolted to the underside of the base top 22. Consequently, the upper end portion of the mechanical arm 4 is free to swing lengthwise of the base 1 toward and away from the upright control box 3 about the pin 26, and also is free to swing transversely of the base about the registered horizontal axes of the bolts 29 and 29' extending lengthwise of the channel member 25.

Figure 5:
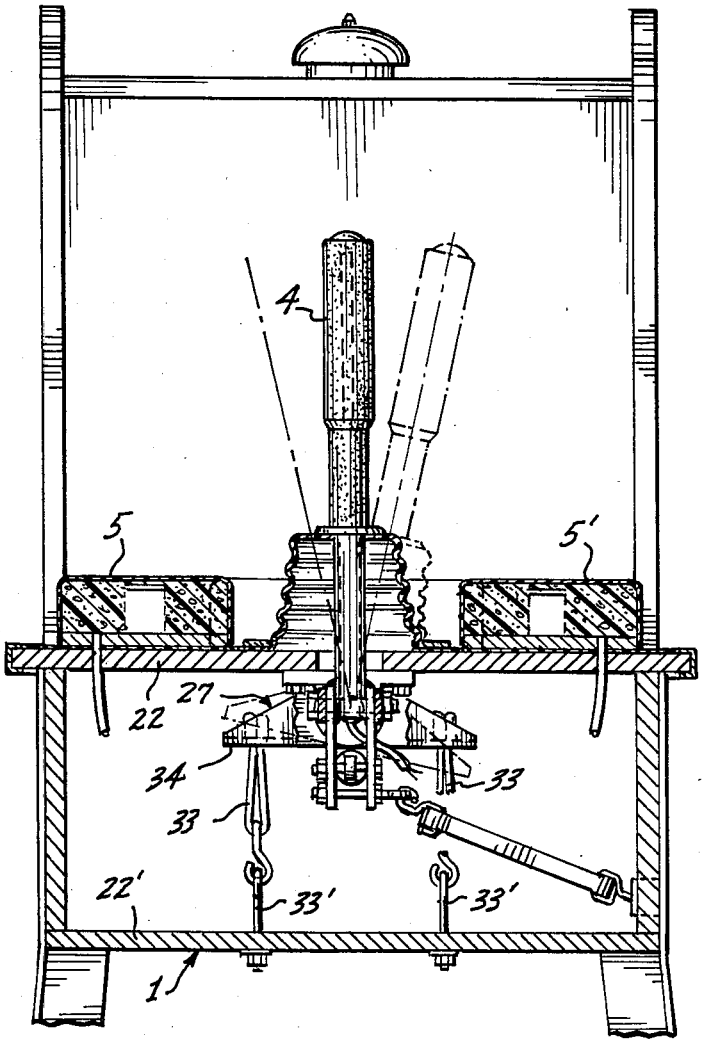
FIG. 5 is a somewhat diagrammatic end elevation of such device with parts broken away.

Transverse swinging movement of the mechanical arm 4 is restrained by elastic straps 33 connected between the horizontal bottom leg or flange 34 of angle bracket 27 and the bottom 22' of the base 1. The straps are positioned at opposite sides, respectively, of the mechanical arm as seen, for example, in FIG. 5, and the force applied by the straps can be adjusted by adjusting the effective lengths of the eye bolts 33' connecting the bottom portions of the straps to the bottom 22' of the base 1. As in an actual arm-wrestling contest, the player can pull the mechanical arm toward himself or herself, such as to the broken line position shown in FIG. 5, against the force of the straps 33, which is important in assuring a realistic feel of the mechanical arm as compared to a human opponent.

Figure 4:
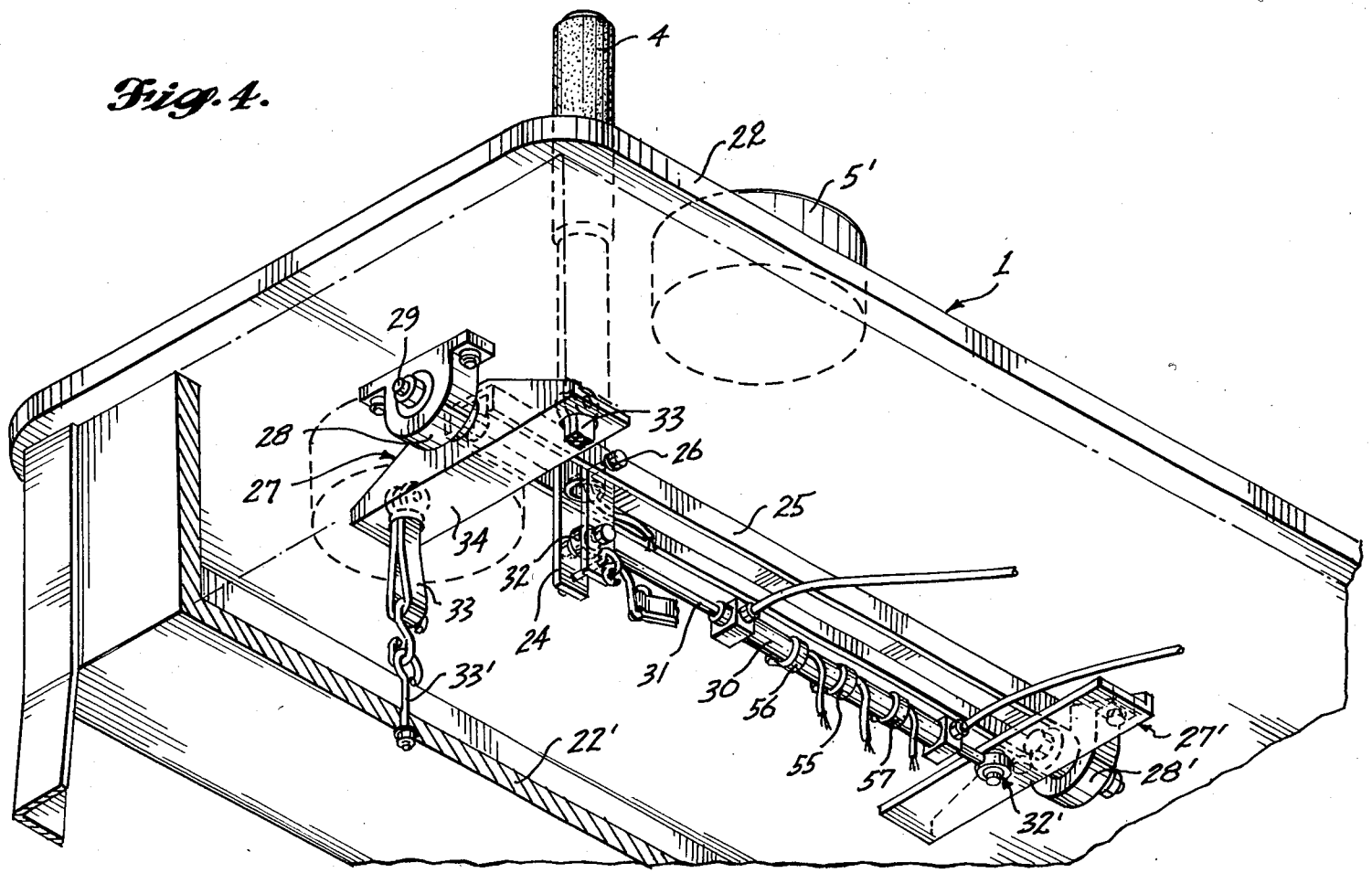
FIG. 4 is a fragmentary bottom perspective of a portion of such device with parts broken away.

As seen in FIGS. 2 and 4, movement of the mechanical arm about the pivot pin 26 is controlled by a hydraulic cylinder 30. One end of the cylinder has a reciprocating plunger 31. The free end portion of the plunger is pivotally connected between the downward-extending mechanical arm plates 24 by a ball joint 32 below the pivot pin 26. The other end of the cylinder 30 is connected to the horizontal flange 34' of the rear angle bracket 27' by a ball joint 32'. Thus, the hydraulic cylinder is substantially rigidly connected to the rotatable channel member 25 to which the mechanical arm 4 is connected by pin 26, and the plunger 31 remains in alignment with the bottom plates 24 of the arm regardless of transverse swinging of the arm.

Hydraulic Circuit

With reference to FIG. 2, the hydraulic cylinder 30 has an inlet hose 35 for receiving liquid under pressure from a pump 36 and an outlet hose 37 for return of liquid to a reservoir 38. Hydraulic liquid under pressure from the pump 36 supplied through inlet hose 35 tends to retract the plunger 31, which tends to swing the upper end portion of the mechanical arm to the broken line position indicated at the left of FIG. 2. Pressure relief valves, including valve 40' adjustable by turning the external knob 10', are provided in the hydraulic circuit and make it possible for a player to resist the force applied by the hydraulic cylinder and to move the mechanical arm against such force to the "winning" position indicated in broken lines to the right in FIG. 2 by application of sufficient force to open one of such relief valves.

Figure 6:
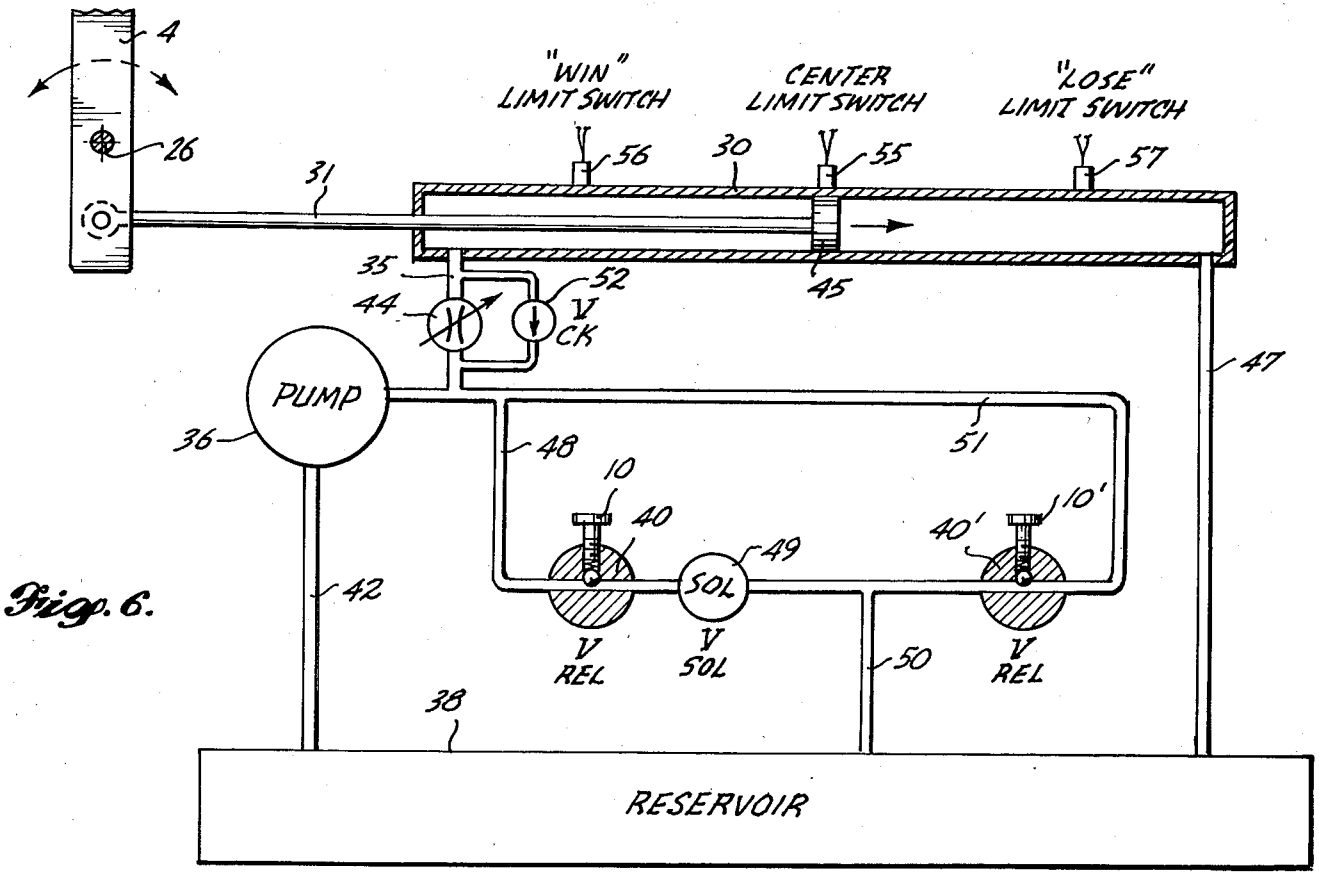
FIG. 6 is a simplified diagram of the hydraulic circuit used in the present invention.

FIG. 6 shows diagrammatically a bottom fragment of the mechanical arm 4, its pivot pin 26 and the long reciprocating plunger arm 31 of the hydraulic cylinder 30. When actuated, pump 36 draws hydraulic liquid from the reservoir 38 through supply line 42 and supplies it under pressure to one end portion of the hydraulic cylinder through an adjustable flow control valve 44 and inlet hose or line 35. Such liquid under pressure tends to move the piston 45 of the hydraulic cylinder to the right, as indicated by the arrow in FIG. 6, forcing hydraulic liquid in the opposite end portion of the cylinder back to the reservoir through a return line 47.

If sufficient resisting force is applied by the player to the upper end portion of the mechanical arm 4 so as to retain the piston 45 stationary or to move it against the flow of hydraulic liquid supplied by the pump, hydraulic liquid flows through the first pressure line 48, relief valve 40 and a normally open solenoid valve 49 back to the reservoir through a second return line 50. Such relief valve 40 corresponds to the "lightweight" setting previously described and opens upon occurrence of a lesser pressure than the other "heavyweight" relief valve 40' which has its own adjustment knob 10'. More specifically, preferably relief valve 40 can be set by turning knob 10 through a first pressure range with the upper end of that range coincidental with the lower end of a second, higher pressure range for the other valve 40'. Because the solenoid valve 49 normally is open, valve 40 normally determines the resisting force which must be applied by the player to prevent losing the simulated contest. For a stronger player, solenoid valve 49 is closed so that the stronger force corresponding to the liquid pressure required to open the other valve 40' must be exerted so as to return hydraulic liquid through a second pressure line 51, valve 40' and the return line 50 back to the reservoir.

The flow control valve 44 determines the maximum speed of movement of the piston 45 and, consequently, its attached plunger 31 and the mechanical arm 4. This is an important safety feature to prevent too sharp a jerk or too quick a push being applied against the player. A bypass check valve 52 is supplied so that when pump 36 is not actuated, there is very little resistance to return of the mechanical arm 4 to its center position by flow of liquid through check valve 52 and back through the pump. Nevertheless, as seen in FIG. 2, there is an elastic strap 53 connected between the bottom end portion of the arm 4 and a side of the base 1 to apply a slight force tending to swing the mechanical arm rearward and retract the plunger 31. The tension applied by the strap is selected so that the rest position of the mechanical arm is approximately midway between the "lose" and "start" positions. At the start of play, the player must move the mechanical arm forward to the start position against the force of strap 53, which helps to prevent the player from being able to move the mechanical arm quickly a substantial distance forward before the full selected pressure is applied to the mechanical arm by the hydraulic cylinder.

The internal cavity of the hydraulic cylinder can be about ¾ inch in diameter by about 8 inches long, such as the Model HVS ¾ by 8 M cylinder available from PHD Inc. of Fort Wayne, Ind. It is preferred that such cylinder have a magnetic plunger element so that the position of the plunger within the cylinder can be sensed by magnetic reed switches attached to the exterior of the hydraulic cylinder and acting as limit switches to sense the position of the plunger. Reed switch number 1446050100 available from the "Cylinder Division" of Parker Hannifin Corporation of Des Plaines, Ill., has been found to be acceptable. In the preferred embodiment, three such reed switches are used, positioned as shown in FIGS. 2, 4 and 6. A center switch 55 is actuated when the plunger is in its central position corresponding to the vertical "start" position of the mechanical arm. A second switch 56 is positioned to sense when the mechanical arm has been moved by the player to the winning position, i.e., against the force of hydraulic liquid supplied by the pump through the supply line 35. A third switch 57 senses when the plunger has been moved by the force of hydraulic liquid supplied by the pump in the direction of the arrow in FIG. 6 sufficiently as to swing the mechanical arm to the losing position.

A representative pump that can be used is a "108 series" pump manufactured by the Oildyne Division of Commercial Shearing, Inc., of Minneapolis, Minn. The pressure relief valves can be the infinitely adjustable "type DBD" pressure relief valves (RA25402) "Size 6" (¼ inch) available from Rexroth Worldwide Hydraulics of Bethlehem, Pa. Any appropriate solenoid valve can be used.

ELECTRICAL CIRCUITS

Power Supply Circuit

Figure 7:
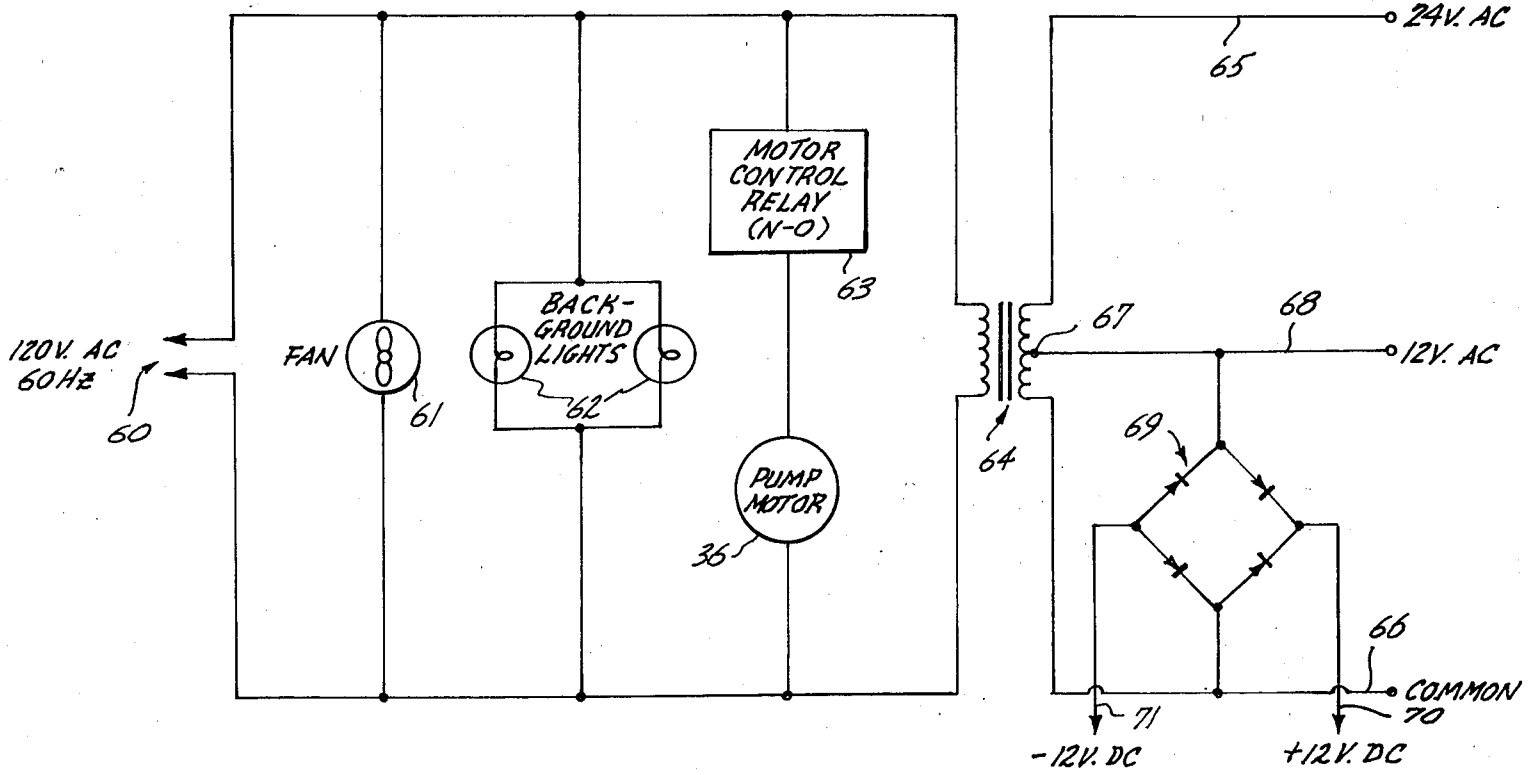
FIGS. 7, 8, 9, 10 and 11 are simplified block diagrams of a representative electrical circuit which can be used in the present invention.

As seen in FIG. 7, power to the electrical components of the device in accordance with the present invention is by way of standard line current applied at the standard plug 60. A fan 61 and background lights 62 are powered continuously. Line current is supplied to the pump 36 only when a normally open (N-O) motor control relay 63 is closed, as described further below. In a representative embodiment, a transformer 64 can be used to convert the standard line current to a lesser 24-volt alternating current supply between lines 65 and 66. A center tap 67 provides a 12-volt alternating current supply between lines 68 and 66 which, by way of a bridge rectifier circuit 69, is converted to a positive 12-volt and negative 12-volt direct current supply at lines 70 and 71, respectively.

Coin-Timer Circuit

Figure 8:
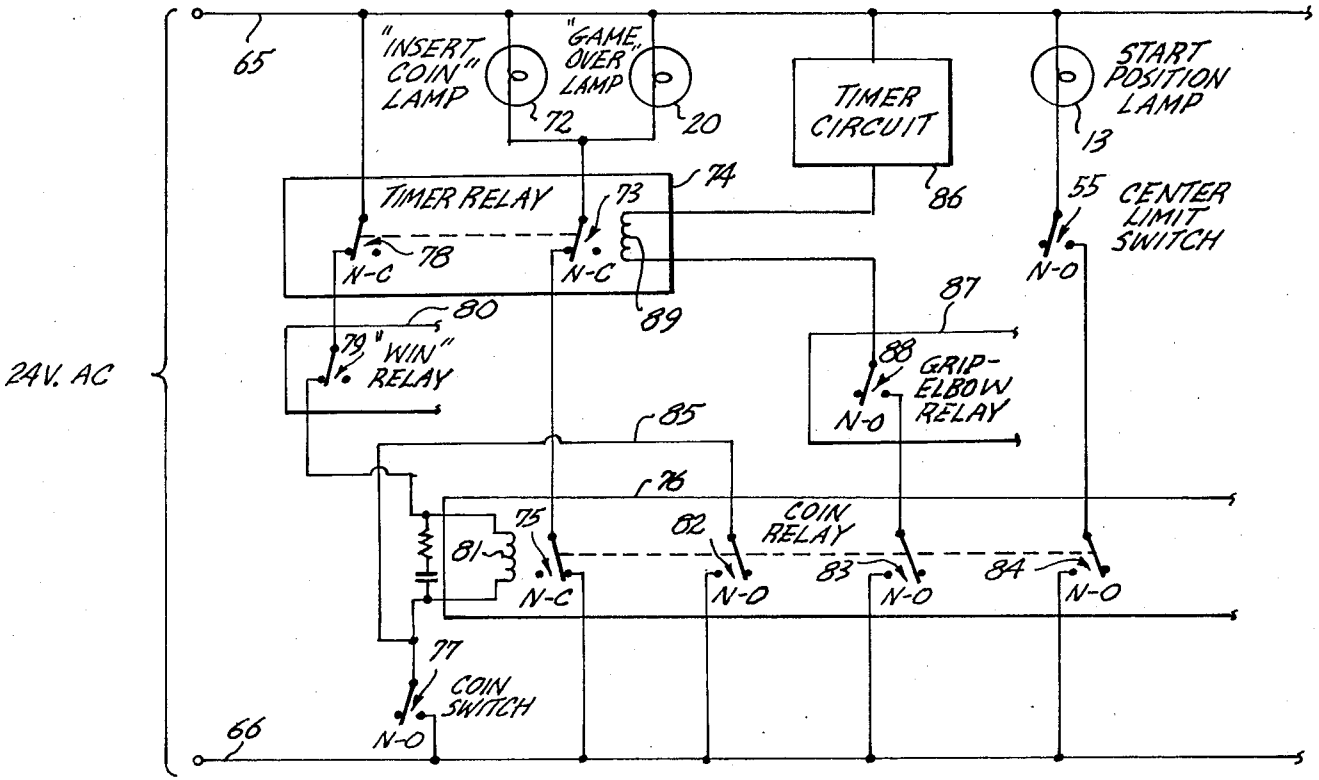

In the unactuated condition shown in FIG. 8, a lamp 72 for the "insert coin" box and slot shown in FIG. 3 and the "game over" lamp 20 are lit by connection between power lines 65 and 66 through the normally closed (N-C) switch 73 of a timer relay 74 and the normally closed switch 75 of a coin relay 76. Referring to the bottom left of FIG. 8, insertion of a coin closes the normally open coin switch 77 which completes another connection between power supply lines 65 and 66 through another normally closed switch 78 of the timer relay 74 and a normally closed switch 79 of a "win" relay 80. The result is to supply power to the actuating coil 81 of the coin relay 76. All switches of the coin relay are thrown, including the normally closed switch 75 which is opened, thereby extinguishing the "insert coin" lamp 72 and the "game over" lamp 20.

The coin relay has various other normally open switches some of which are shared by more than one component. For ease of illustration and understanding, however, the coin relay is illustrated and described herein as having additional normally open switches which are not necessarily shared, such as the normally open switches 82, 83 and 84 shown in FIG. 8.

Actuation of the coin relay by insertion of a coin closes each of switches 82, 83 and 84. Closing of switch 82 has the effect of latching the coin relay in its actuated condition by completing the loop from the coil 81 through lead 85 and such switch 82 to the common or neutral line 66.

The concurrent closing of switch 84 of the coin relay 76 allows the "start position" lamp 13 to be lit when the mechanical arm is moved to its central or starting position so as to close the normally open center limit switch (magnetic reed switch) 55.

The concurrent closing of switch 83 of coin relay 76 allows actuation of a timer circuit 86, but only if another relay 87 is actuated. Such relay is referred to as the "grip-elbow" relay because its normally open switch 88 is closed only if the player's elbow is resting on one of the elbow pads and the upper portion of the mechanical arm is being gripped.

For example, after insertion of a coin, the mechanical arm is moved to its central starting position, as will be indicated by lighting of the "start position" lamp 13. The player positions his or her elbow on the appropriate elbow pad and grips the upper portion of the mechanical arm which, in combination, results in actuating the grip-elbow relay 87, thereby closing its switch 88. The timer circuit 86 senses the closing of switch 88 in combination with the closing of switch 83 of the coin relay and acts as an open circuit for a predetermined period which constitutes the maximum playing time allowed without restarting the device by insertion of another coin. The maximum playing time can be one minute. At the end of such period, the timer circuit closes momentarily, thereby applying power at the timer relay coil 89 which opens the timer relay switches 73 and 78. Opening of switch 78 breaks the supply of power to the coin relay coil 81 so that all of the coin relay switches return to their normal positions shown in FIG. 8. After its momentary closing, the timer circuit resumes its normal open circuit condition so that the switches 73 and 78 of the timer relay 74 also return to their normal positions shown in FIG. 8. The "insert coin" and "game over" lamps are again lit. During the playing time, the timer circuit ignores any additional closing or opening of the grip-elbow relay switch 88.

After actuation of the coin relay 76 by insertion of a coin to close the coin switch 77, the only other condition which will unlatch the coin relay is actuation of the "win" relay as described below, which opens normally closed switch 79 and, consequently, cuts off the supply of power to the coin relay coil 81.

High-Low Selection

In actual play, after inserting a coin and before actuating the timer circuit, the player would select the appropriate maximum force to be applied by the machine by use of the buttons 9 and 9' and pressure relief valve knobs 10 and 10' shown in FIG. 3. A corresponding electrical circuit is illustrated diagrammatically FIG. 9. Another normally open switch 90 of the coin relay 76 controls the supply of power to a separate high-low relay 91. Such relay has a normally closed switch 92 controlling the supply of power to a lamp 93 for the lightweight button 9 and a lamp 94 for the lightweight dial 12. Consequently, each time a coin is inserted, the lightweight setting is automatically selected.

If the heavyweight setting is desired, the heavyweight button 9' is pressed which has the effect of closing the normally open switch 95 of a heavyweight relay 96. Power is conveyed through the normally closed switch 97 controlled by the lightweight button 9 to the coil 98 of the heavyweight relay, latching it in its actuated condition. Simultaneously, power is supplied to the coil 99 of the high-low relay 91 which, in addition to opening its normally closed switch 92 so as to extinguish the lightweight lamps 93 and 94, closes the normally open switch 100 thereby lighting the heavyweight button lamp 101, a lamp 102 for the heavyweight dial and also supplying power to the solenoid valve 49. Such valve is also represented in the hydraulic circuit shown in FIG. 6. As previously described, actuating such valve prevents passage of hydraulic liquid through the "weaker" relief valve 40 forcing it to pass through the "stronger" relief valve 40' which is adjusted by the knob 10' represented in FIG. 3.

Figure 9:
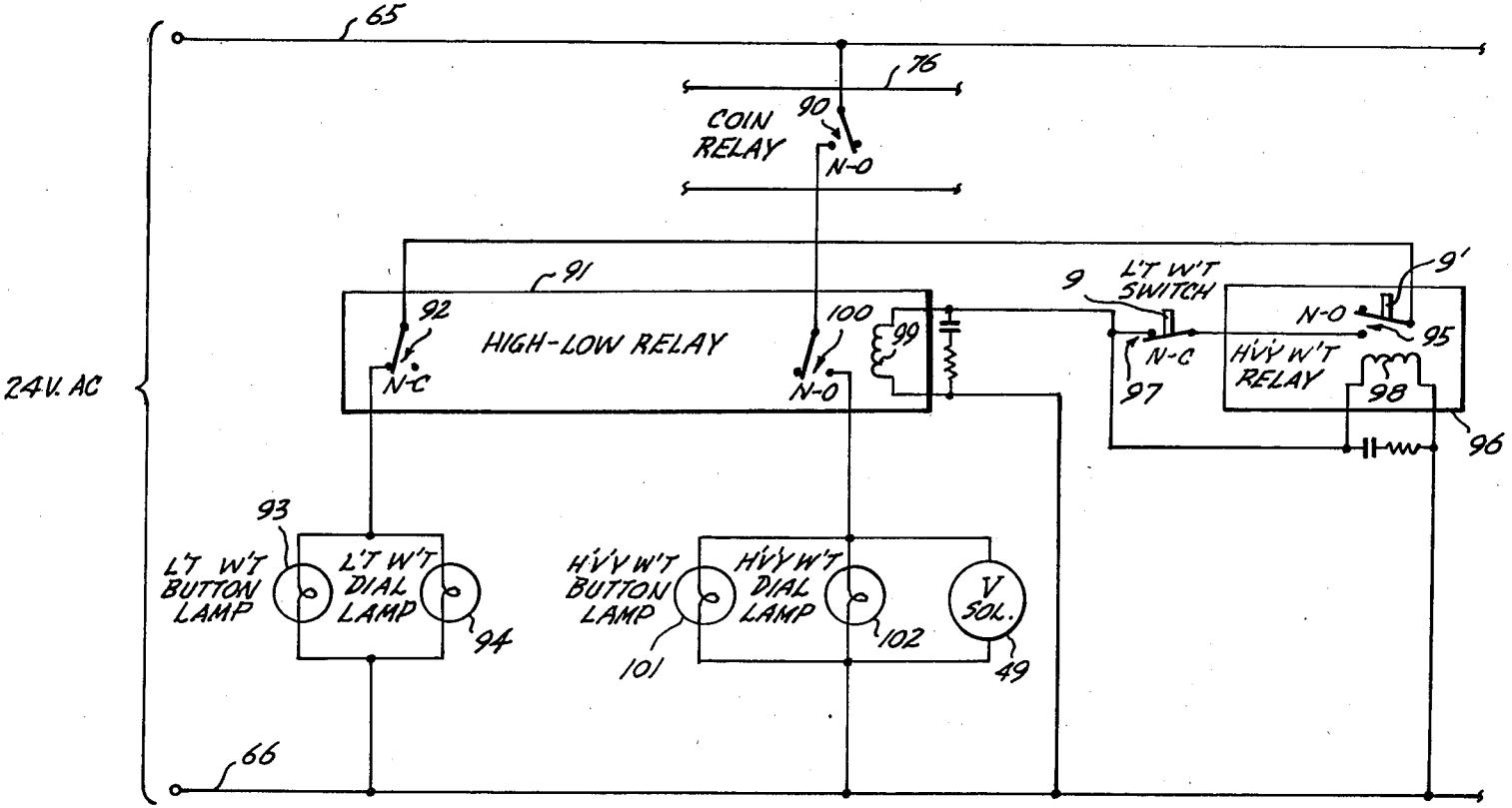

At any time during normal play the lightweight setting can again be selected by pushing button 9 which, with reference to FIG. 9, opens the loops for the actuating coils 98 and 99 of the relays 96 and 91, returning their switches to the normal positions shown in FIG. 9 in which the solenoid valve 49 is not actuated and only the lightweight lamps 93 and 94 are lit.

Motor Control and "Foul" Circuitry

Figure 10:
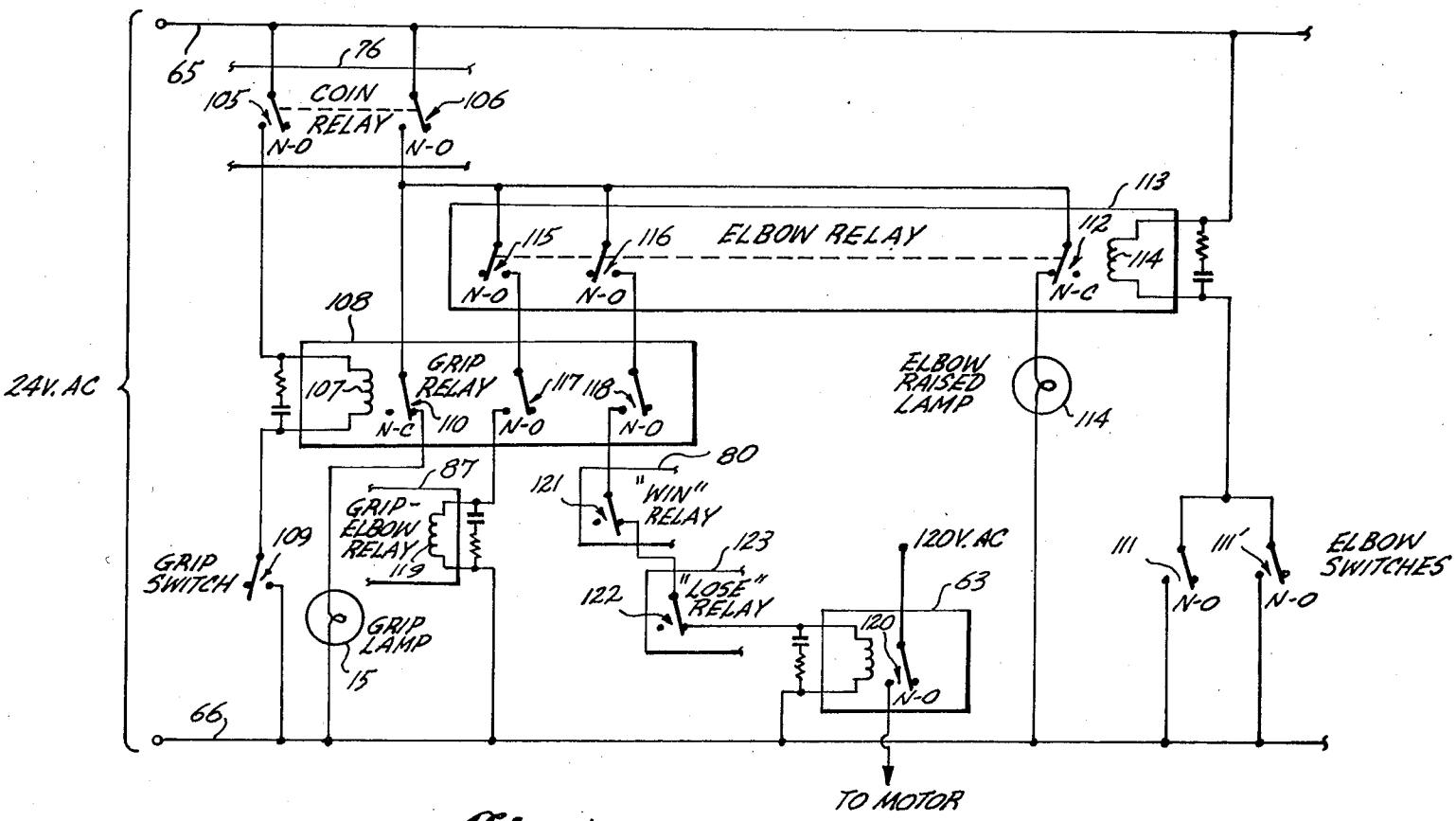

Toward the top of FIG. 10 the coin relay 76 is shown as having two additional, normally open switches 105 and 106. Such switches are closed upon insertion of a coin as previously described.

Switch 105 is in series with the actuating coil 107 of a grip relay 108 and a normally open grip switch 109. The grip switch preferably is a pressure-sensitive switch which extends along the leading side of the mechanical arm so that it will be actuated by the player's fingers wrapped around the arm at almost any location along the length of the upper portion of the arm. Various types of acceptable switches are manufactured by Tapeswitch Corporation of America of Farmingdale, N.Y. With the coin relay actuated and the grip switch in its normally open condition, power to the "grip-arm" lamp 15 is conducted through switch 106 of the coin relay and the normally closed switch 110 of grip relay 108. Whenever the grip switch is closed by the player gripping the mechanical arm, grip relay 108 is actuated, which opens switch 110 and extinguishes lamp 15. Similarly, referring to the opposite portion shown toward the right of FIG. 10, there are two normally open elbow switches 111 and 111' which preferably are pressure-sensitive switches incorporated into or below the two elbow pads, respectively. If both switches 111 and 111' are in their normally open conditions, power is conveyed to the "elbow-raised" lamp 14 through the normally closed switch 112 of the elbow relay 113. If either switch 111 or 111' is closed, power is supplied to the actuating coil 114 of relay 113 thereby opening switch 112 and extinguishing lamp 14.

The elbow relay 113 has two normally open switches 115 and 116 and the grip relay 108 has two normally open switches 117 and 118. Switch 115 of the elbow relay is in series with switch 117 of the grip relay and also is in series with the actuating coil 119 of the grip-elbow relay 87. Referring to FIG. 8, it is the grip-elbow relay 87 which must be actuated in order to actuate the timer circuit 86.

Returning to FIG. 10, switch 116 of the elbow relay 113 and switch 118 of the grip relay 108 are in series with the actuating coil of the motor control relay 63 having the normally open switch 120. Consequently, no power is supplied to the pump motor unless all three of the coin relay, the elbow relay and the grip relay are actuated. Any lessening of the player's grip or lifting of the player's elbow automatically results in cutting off the supply of power to the motor. The other conditions which will cut off the supply of power to the motor are opening of either of the normally closed switches 121 and 122 of the win relay 80 and a lose relay 123, controlled by the magnetic reed switches at the opposite ends of the hydraulic cylinder.

Win-Lose Circuitry

Figure 11:
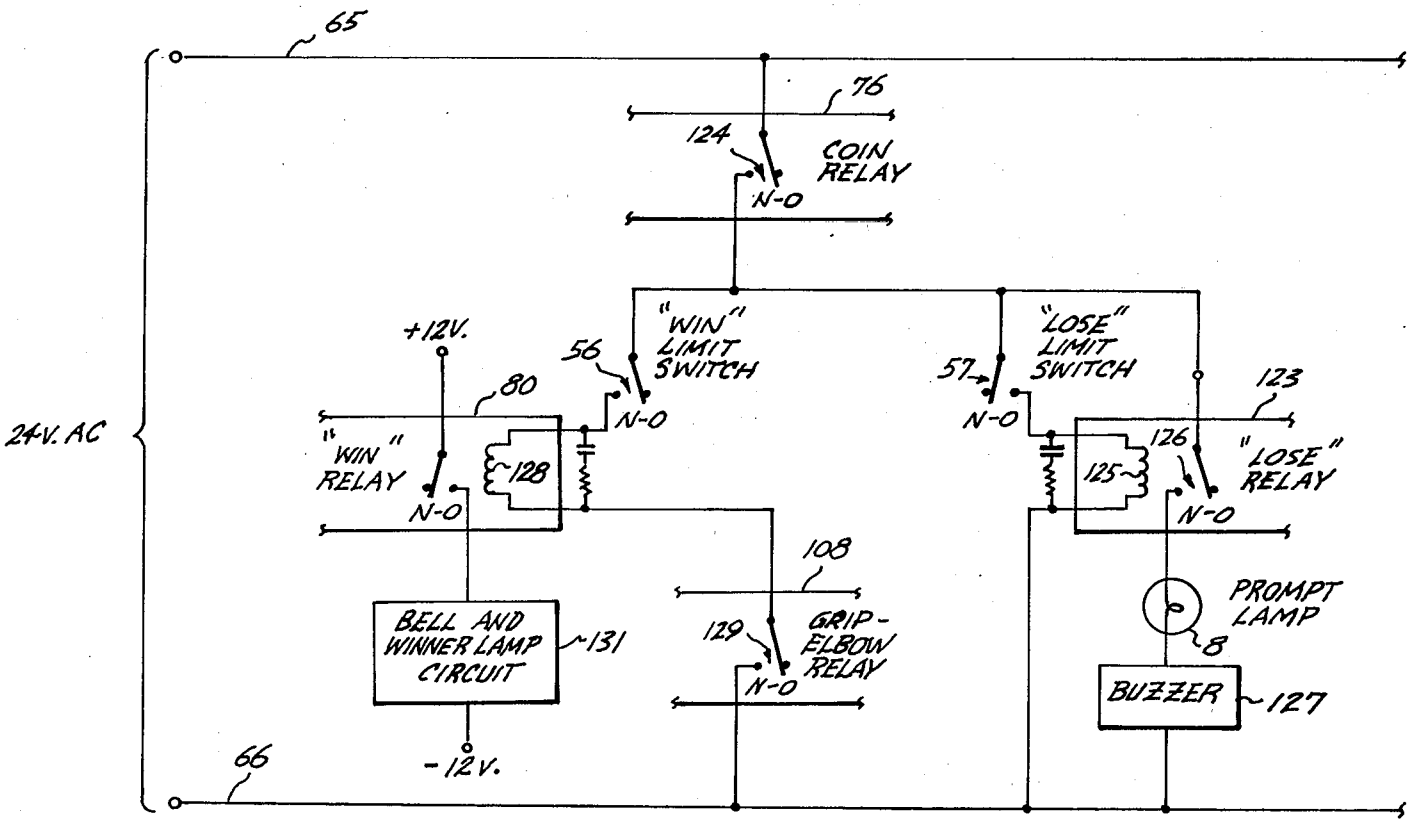

As seen in FIG. 11, the normally open lose limit switch 57 is in series with another normally open switch 124 of the coin relay 76. Upon actuation of the coin relay, closing of the lose limit switch by movement of the internal piston of the hydraulic cylinder supplies power to the actuating coil 125 of the lose relay 123. With reference to FIG. 10, actuation of the lose relay cuts off the supply of power to the pump motor. With reference to FIG. 11, actuation of such relay also closes a normally open switch 126 to supply power to lamp 8 prompting the player to reset the maximum force to be applied by the machine ("select proper dial and weight") if desired. A buzzer 127 also can be provided to be actuated when the lose limit switch is closed.

At the other side of the circuit shown in FIG. 11, the normally open win limit switch 56 is in series with the coin relay switch 124 and the actuating coil 128 of the win relay 80. Further, switches 124 and 56 and the actuating coil 128 are in series with a normally open switch 129 of the combined grip-elbow relay 108. The result is that the coil 128 of the win relay is actuated only if the coin relay is actuated (indicating that the time limit has not expired), the win limit switch is closed (indicating that the mechanical arm has been moved to the winning position) and the grip-elbow relay has been actuated (indicating that the player's elbow has not been lifted nor has the player's grip been released). Upon simultaneous occurrence of all of these conditions, the win relay is actuated to close its normally open switch 130 and supply direct current power from the bridge rectifier circuit to another circuit 131 for sounding the bell 18 and actuating the flashing winner lamp 19 a predetermined period. In addition, actuation of the win relay 80 unlatches the coin relay as seen in FIG. 7, thereby actuating the coin and game over lamps and preventing further play until another coin is inserted.

I claim:

1. In a strength training amusement device for simulating an arm-wrestling contest for use by a player and including a base, a generally upright mechanical arm, means mounting the mechanical arm to the base for movement relative thereto in a generally vertical plane and power-drive means for applying a force tending to move the arm in a first direction in such plane for resistance by the player, the improvement comprising the mechanical arm mounting means including a support member, a first means mounting the mechanical arm to said support member for swinging relative thereto in the generally vertical plane, and a second means mounting the support member to the base for swinging of said support member relative to the base so as to move the mechanical arm transversely of the direction of movement caused by the power-drive means.

2. In the device defined in claim 1, the first means including pivot means mounting the mechanical arm to the support member for swinging about an axis, and the second means mounting the support member to the base for permitting rotation of the support member about an axis extending transversely to said axis of the pivot means.

3. In the device defined in claim 2, means for resiliently resisting rotation of the support member.

4. In the device defined in claim 1, the power-drive means including a hydraulic cylinder mounted on the support member for conjoint movement with the support member relative to the base.

* * * * *